United States Patent [19]

Reynard et al.

[11] 4,401,858

[45] Aug. 30, 1983

[54] METHOD FOR CONTROLLING WRINKLES IN A VIBRATILE DIAPHRAGM

[75] Inventors: John M. Reynard, Framingham; Thomas N. Carignan, Danvers; Richard Paglia, Carlisle; Joseph R. Rich, Danvers, all of Mass.

[73] Assignee: Polaroid Corporation, Cambridge, Mass.

[21] Appl. No.: 247,124

[22] Filed: Mar. 24, 1981

Related U.S. Application Data

[60] Continuation-in-part of Ser. No. 113,581, Jan. 21, 1980, abandoned, which is a division of Ser. No. 900,016, Apr. 25, 1978, Pat. No. 4,215,249.

[51] Int. Cl.[3] ..... H04R 19/00

[52] U.S. Cl. ..... 179/111 R; 29/594

[58] Field of Search ..... 179/111 R, 111 E; 29/594

[56] References Cited

U.S. PATENT DOCUMENTS 4,085,297 4/1978 Paglia ..... 179/111 R

*Primary Examiner*—Benjamin R. Fuller

*Attorney, Agent, or Firm*—John J. Kelleher

[57] ABSTRACT

A method and device for significantly improving the efficiency and sensitivity of an electroacoustical transducer. A relatively inelastic vibratile diaphragm is preformed to the shape of a mating backplate prior to the time it is actually mated to said backplate. By such preforming, the efficiency and sensitivity reducing effects from a wrinkled transducer diaphragm are minimized in that said wrinkles move to a diaphragm region where they have no effect on transducer sensitivity when the backplate is subsequently mated to said diaphragm.

1 Claim, 14 Drawing Figures

METHOD FOR CONTROLLING WRINKLES IN A VIBRATILE DIAPHRAGM

CROSS-REFERENCE TO RELATED APPLICATIONS

This is a continuation-in-part of application Ser. No. 113,581, filed Jan. 21, 1980, now abandoned which, in turn, is a division of application Ser. No. 900,016, filed Apr. 25, 1978, now U.S. Pat. No. 4,125,249.

BACKGROUND OF THE INVENTION

1. Field of the Invention

The present invention relates to electroacoustical transducers in general, and to vibratile diaphragms in such transducers, in particular.

2. Description of the Prior Art

Capacitance type electroacoustical transducers are well known in the prior art. In such transducers, a diaphragm having an insulative layer and an electrically conductive surface has its insulative layer in contact with a grooved, irregular, electrically conductive surface of a substantially inflexible disc or backplate. The periphery of the diaphragm is maintained in a fixed position with respect to the transducer housing and a spring force urges said backplate into tensioning engagement with said diaphragm. The insulative layer, the electrically conductive surface of said diaphragm constituting a first electrode, and the conductive surface of said backplate constituting a second electrode, form a capacitor such that when a dc bias voltage is applied across said electrodes, irregularities in said backplate surface set up localized concentrated electric fields in said insulative layer. When an ac signal is superimposed on said dc bias, the insulative layer is stressed such that oscillatory formations develop causing an acoustical wavefront to be propagated from the diaphragm. A received acoustical wave-front impinging on the insulative layer produces a variable voltage across said capacitor electrodes.

An extremely important design consideration for the above-described transducer is the amount of tension in the transducer diaphragm. In addition to such factors as resonant frequency and output magnitude, diaphragm tension also affects transducer sensitivity in at least two ways. Within limits, less diaphragm tension provides greater reception sensitivity. Also, incorrect diaphragm tension may introduce stress patterns into the diaphragm causing said diaphragm to wrinkle which will affect the ability of the diaphragm to uniformly contact a backplate surface. Such nonuniform diaphragm contact will directly affect transducer efficiency and therefore indirectly affect transducer sensitivity. When a wrinkled diaphragm nonuniformly contacts said backplate surface, those wrinkled diaphragm areas that are spaced a significant distance from said surface will produce less capacitance change per unit of diaphragm movement from a received acoustical wavefront, or cause a lower magnitude wavefront to be propagated during transmission, than those diaphragm areas that are not so spaced from said backplate surface. This is of more concern in the reception of an acoustical signal where signal levels tend to be low than in the transmission of a signal where signal levels tend to be relatively high. This is also of more concern in a small electroacoustical transducer whose sensitivity is necessarily low from its smaller size than in a large electroacoustical transducer with its larger transducer components.

Prior art electroacoustical transducers have their diaphragms peripherally clamped and have either zero or a predetermined amount of tensioning force on said diaphragms prior to diaphragm/backplate engagement. In such transducers, diaphragm tensioning is either introduced or increased by properly mating the backplate to the diaphragm. This type of diaphragm tensioning introduces at least some sensitivity reducing diaphragm wrinkles, especially when the backplate has a raised center portion that is sometimes referred to a a crown. If diaphragm wrinkles can be reduced or eliminated from the diaphragm/electrically conductive backplate surface interface, improved transducer efficiency and sensitivity will result.

SUMMARY OF THE INVENTION

In accordance with the teachings of the present invention, a method and device are provided for significantly improving the efficiency and sensitivity of an electroacoustical transducer of the type having a vibratile member and a cooperatively engaged backplate member. An outer diaphragm region of said vibratile diaphragm is placed in a fixed position with respect to the housing of said transducer after the inner region of said diaphragm has been placed over an opening in said housing and offset from a plane through said outer diaphragm region. By so offsetting said inner diaphragm region, diaphragm wrinkles that would otherwise occur at the diaphragm/backplate interface are moved to a portion of the diaphragm where said wrinkles cannot affect transducer efficiency or sensitivity, as said backplate is mated to said diaphragm.

DESCRIPTION OF THE PREFERRED EMBODIMENTS

Figure 1A:
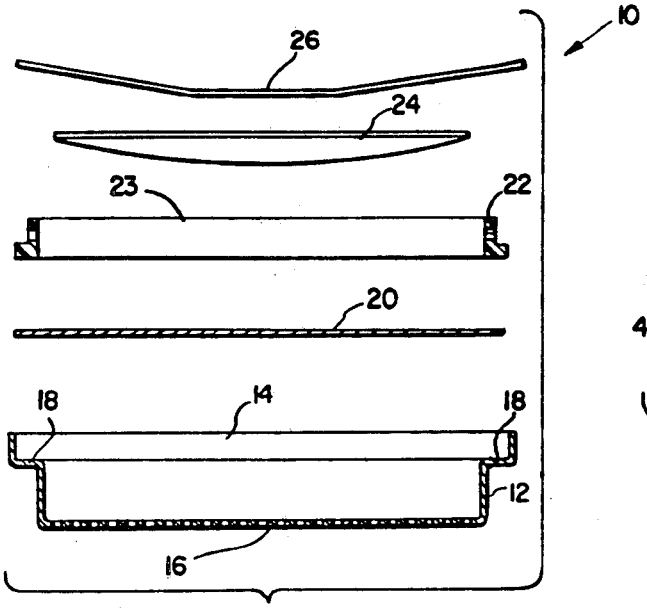
FIG. 1A (PRIOR ART)
FIG. 1A is an exploded view of an electroacoustical transducer constructed in accordance with the teachings of the prior art.

Referring now to the drawings and specifically to FIG. 1A, an electroacoustical transducer 10 constructed in accordance with the teachings of the prior art is depicted. Transducer 10 includes cylindrical housing 12 having open end 14 and partially closed perforated end 16. Housing 12 also includes flanged portions 18 near open end 14 of said housing 12. Flat vibratile diaphragm 20 extends across opening 14 and is positioned between diaphragm support ring 22 and said housing 12. Diaphragm support ring 22 is of circular cross section with an opening 23 through the center thereof and has a flanged end for cooperative engagement with flanged portion 18 of housing 12. Backplate 24, of circular cross section, includes a crowned electrically conductive surface for cooperative engagement with diaphragm 20. Leaf spring 26 provides the force that maintains backplate 24 in cooperative engagement with diaphragm 20. When assembled, the transducer components described in FIG. 1A are in the position shown in FIG. 1B.

Figure 1B:
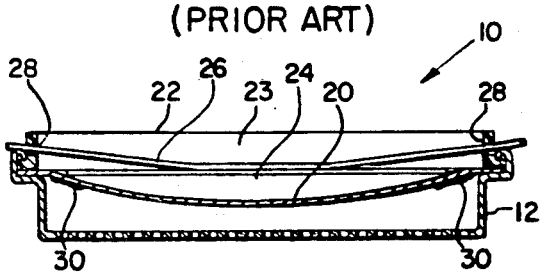
FIG. 1B (PRIOR ART)
FIG. 1B is a sectional view, in elevation, of the transducer of FIG. 1, fully assembled.
Figure 1C:
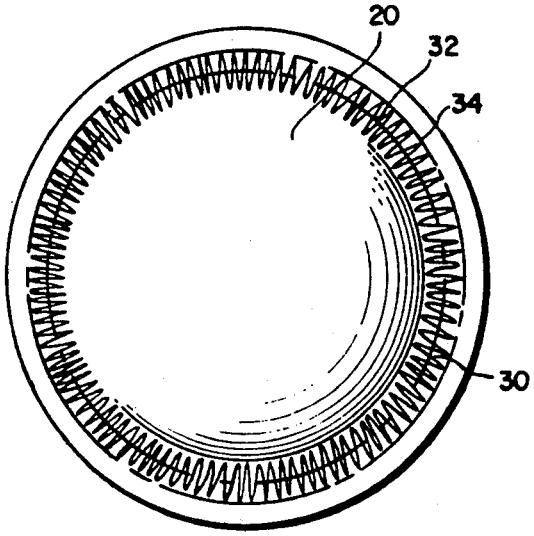
FIG. 1C (PRIOR ART)
FIG. 1C is a top view of the transducer diaphragm in FIG. 1B showing the stress pattern in said diaphragm.

FIG. 1B is a sectional view, in elevation, of the transducer components illustrated in FIG. 1, fully assembled. The transducer of FIG. 1B is assembled by placing a uniform radial force on diaphragm 20 for the purpose of maintaining said diaphragm in a relatively flat plane and then positioning said diaphragm 20 over opening 14 (FIG. 1) of housing 12. With diaphragm 20 maintained in this planar orientation, the periphery of said diaphragm 20 is sandwiched between the flanged end of ring 22 and flange portion 18 of housing 12, and then the open end of housing 12 is crimped onto said ring 22 which places the periphery of diaphragm 20 in a fixed position with respect to said housing 12. Crowned backplate 24 is placed in opening 23 of support ring 22 such that the crowned surface of said backplate 24 engages diaphragm 20 and forms said diaphragm 20 into the same general shape as the crowned surface of said backplate 24. With backplate 24 so positioned, leaf spring 26 is inserted through openings 28 in support ring 22 such that the center portion of leaf spring 26 presses against backplate 24 and the ends of leaf spring 26 rest against the walls in openings 28 of support ring 22. With leaf spring 26 so positioned, diaphragm 20 remains formed to the general shape of the crowned surface of backplate 24. By assembling transducer 10 in this manner, wrinkles, designated as reference numeral 30, are formed at the unclamped periphery of diaphragm 20 as a result of a nonuniform stress pattern being introduced into said diaphragm 20 when backplate 24 fully engaged diaphragm 20 in the previously described manner. The wrinkles 30 appearing at the periphery of the unclamped portion of diaphragm 30 have been exaggerated in FIG. 1B for illustrative purposes only, these wrinkles being more clearly shown in FIG. 1C.

In FIG. 1C, a top view of transducer diaphragm 20 in FIG. 1B depicts the wrinkles created by the nonuniform stress pattern in said diaphragm 20, in greater detail. Reference numeral 32 designates the outer limit of the interface between backplate 24 (FIG. 1B) and diaphragm 20, and reference numeral 34 designates the inner limit of the interface between support ring 22 (FIG. 1B) and said diaphragm 20. As can be clearly seen in FIG. 1C, wrinkles 30 extend well into the diaphragm 20 and backplate 24 interface. The effect of such wrinkles is to reduce the contact area between these components which, in turn, reduces transducer efficiency and sensitivity.

Figure 2A:
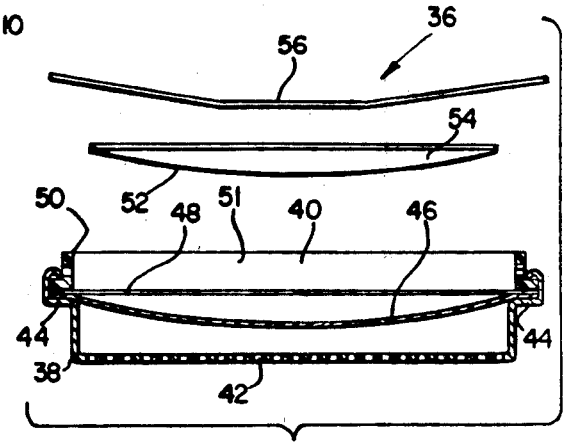
FIG. 2A is a partially assembled, exploded view, in elevation, of an electroacoustical transducer constructed in accordance with the present invention.

Turning now to FIG. 2A, a partially assembled exploded view, in elevation, of electroacoustical transducer 36 constructed in accordance with the present invention is depicted. Transducer 36 includes cylindrical housing 38 having open end 40 and partially closed end 42. Cylindrical housing 38 also includes flange portion 44 near its said open end 40. Circular vibratile diaphragm 46, having paper tensioning ring 48 attached to its periphery for maintaining a light uniform radially outward force on said diaphragm 46, has been placed in opening 40 of housing 38 and rests on flange portion 44 of said housing 38. Diaphragm support ring 50, of circular cross section with opening 51 through the center thereof, has a flanged end engaging said paper ring 48, said ring being attached to the periphery of diaphragm 46. An assembly tool (FIG. 3A) has preformed diaphragm 46 to the shape of surface 52 of backplate 54, and while said diaphragm 46 was in this preformed shape, open end 40 of housing 38 was crimped onto the flanged end of said support ring 50 which placed the periphery of diaphragm 46 in a fixed position with respect to housing 38 and resulted in the inner region of diaphragm 46 being offset from a plane through the clamped periphery of said diaphragm 46. Backplte 54, of circular cross section, includes curved or crowned electrically conductive surface 52 for engagement with diaphragm 46. Leaf spring 56 provides the force that maintains backplate 54 in cooperative engagement with diaphragm 46. When fully assembled, the transducer components described in FIG. 2A are in the position shown in FIG. 2B.

Figure 2B:
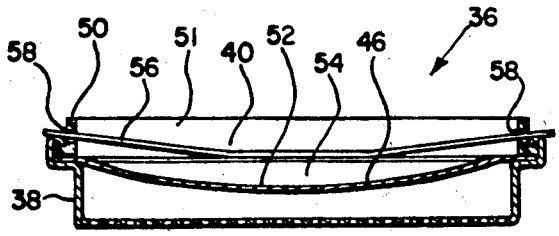
FIG. 2B is a sectional view, in elevation, of the transducer of FIG. 2A, fully assembled.

FIG. 2B is a sectional view, in elevation, of the transducer components illustrated in FIG. 2A, fully assembled. Crowned backplate 54 is placed in opening 51 of support ring 50 such that crowned surface 52 of said backplate 54 cooperatively engages diaphragm 46. With backplate 54 so positioned, leaf spring 56 is inserted through openings 58 in support ring 50 such that the center portion of leaf spring 56 presses against backplate 54, and the ends of said leaf spring 56 rest against the walls in openings 58 of support ring 50. By assembling transducer 36 in this manner, wrinkles that would otherwise form in the interface between diaphragm 46 and backplate 54 have been moved out of said interface and into the periphery of diaphragm 46. The location of these wrinkles with respect to the diaphragm 46 and backplate 54 interface are more clearly shown in FIG. 2C.

Figure 2C:
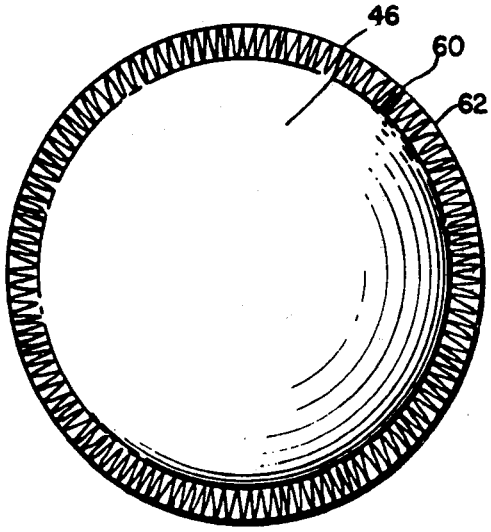
FIG. 2C is a top view of the transducer diaphragm in FIG. 2B showing the stress pattern in said diaphragm.

In FIG. 2C, a top view of transducer diaphragm 46 of FIG. 2B illustrates the position of the wrinkles in said diaphragm 46 with respect to the diaphragm 46/backplate 54 interface. Reference numeral 60 designates the outer limit of the interface between backplate 54 (FIG. 2B) and diaphragm 46, and reference numeral 62 designates the outer limit of said diaphragm 46. From FIG. 2C it can be seen that wrinkles introduced into diaphragm 46 during diaphragm 46 to housing 38 assembly, are confined to the region between diaphragm 46/backplate 54 interface limit 60, and the outermost limit 62 of said diaphragm 46 and said support ring 50 interface. By assembling transducer 36 in the above-described manner, uniform contact between diaphragm 46 and curved surface 52 of backplate 54 (FIG. 2A) and the proper tensioning of said diaphragm 46 are achieved which, in turn, substantially improves transducer 36 efficiency and sensitivity over, for example, prior art transducer 10.

Figure 3A:
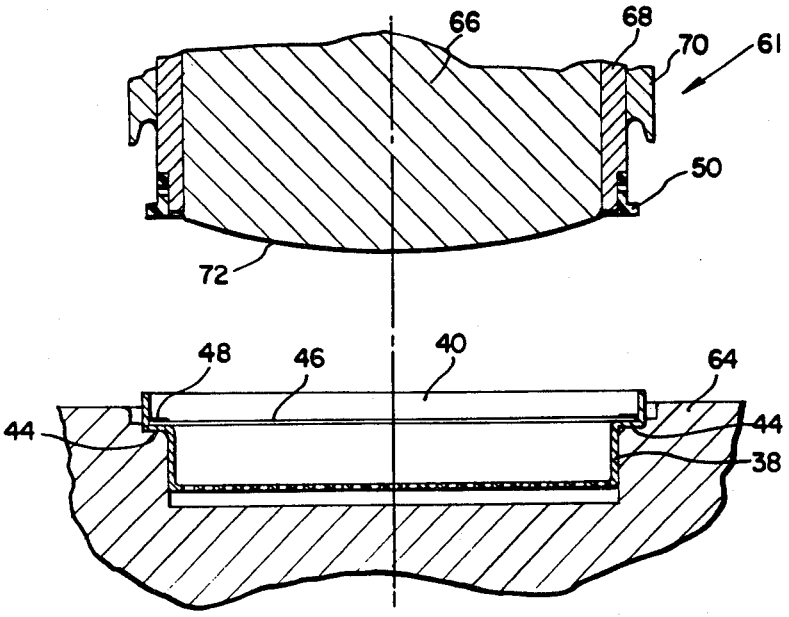
FIG. 3A is an elevational view of a transducer housing, diaphragm and assembly tool positioned for diaphragm-to-housing assembly.
Figure 3B:
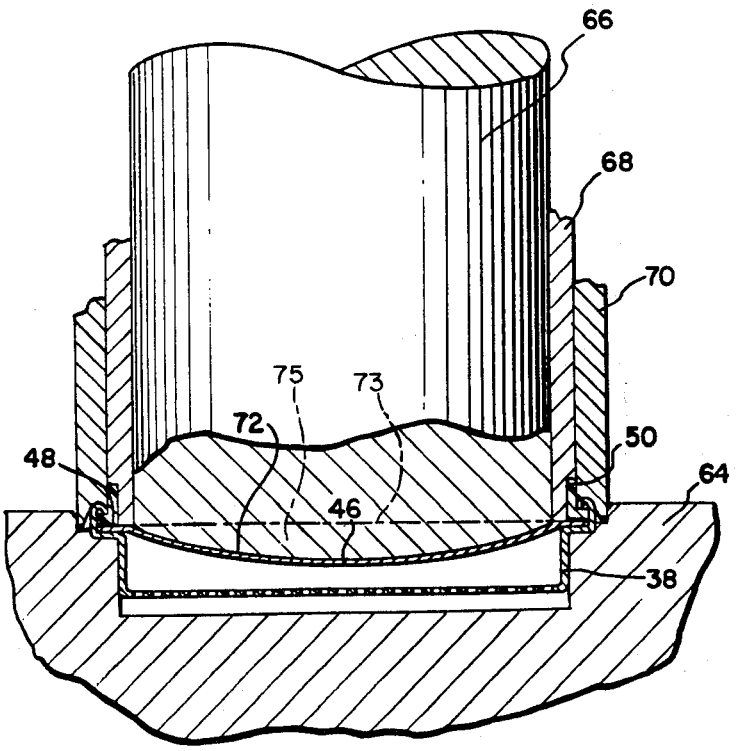
FIG. 3B is an elevational view of the transducer housing, diaphragm and assembly tool in FIG. 3A showing said diaphragm in an offset condition and fixedly attached to said housing.

In the assembly of transducer 36 illustrated in FIG. 2A, mention was made of an assembly tool for preforming the diaphragm of said transducer 36 to the shape of a curved backplate surface. Transducer 36 assembly tool 61 is depicted in FIG. 3A. With reference to FIG. 3A, housing 38 of transducer 36 (FIG. 2B) is positioned in housing support fixture 64 such that flanged portion 44 of said housing 38 rests on said support fixture 64. Diaphragm 46, having paper, tensioning ring 48 fixedly attached to its periphery by an adhesive, is placed in opening 40 of transducer housing 38 such that said diaphragm rests on said flanged portion 44. The purpose of tensioning ring 48 is to temporarily maintain the periphery of diaphragm 46 in a planar orientation. In addition to support fixture 64, assembly tool 61 also includes cylindrical rod 66, cylindrical sleeve 68, and crimping ring 70. Rod 66 includes curved end 72 having the same curved shape as curved surface 52 in backplate 54 (FIG. 2A). Sleeve 68 is concentrically mounted with respect to the vertical central axis through rod 66 and is slidable in the direction of said central axis along the cylindrical outer surface of said rod 66. Sleeve 68 includes a shouldered end portion on which diaphragm support ring 58 is mounted prior to assembling ring 50 on housing 38. Crimping ring 70, concentrically mounted with respect to said central axis through rod 66, is slidable along the cylindrical outer surface of sleeve 68. The end of crimping ring 70 includes a tapered end portion for crimping the open end of housing 38 onto support ring 50 after said support ring 50 has been inserted into opening 40 of housing 38 to the point where it contacts tensioning ring 48. With support ring 50, diaphragm 46, tensioning ring 48 and housing 38 positioned as in FIG. 3A, diaphragm 46 is ready to have its inner region preformed or offset and to have its periphery placed in a fixed position with respect to housing 38. FIG. 3B illustrates the position of assembly tool 61 when diaphragm 46 has been preformed to the shape of curved surface 52 of backplate 54 (FIG. 2A) and the periphery of said diaphragm 46 has been placed in a fixed position with respect to housing 38 and support ring 50.

FIG. 3B is a sectional view in elevation of transducer housing 38 and diaphragm 46 of FIG. 3A showing said diaphragm 46 in a preformed condition and fixedly attached to said housing 38. Diaphragm 46 was preformed by moving curved surface 72 of rod 66 into engagement with diaphragm 46. As the curved end of rod 66 engaged diaphragm 46, the inner region of said diaphragm 46 was offset from a plane through the periphery of said diaphragm 46. As said inner diaphragm 46 was so offset, the force applied to a diaphragm 46 by rod 66 overcame the tensioning force provided by paper tensioning ring 48 causing the periphery of diaphragm 46 to move uniformly inward. Once the inner region of diaphragm 46 was fully offset, sleeve 68 moved support ring 50 into gripping engagement with tensioning ring 48 thereby maintaining the periphery of said diaphragm 46 in a fixed position with respect to housing 38 and said support ring 50. With the periphery of diaphragm 46 maintained in a fixed position with respect to housing 38 and support ring 50, the tapered end of crimping ring 70 is moved into engagement with the open end of housing 38 thereby crimping said open end of housing 38 onto support ring 50 which maintains the periphery of diaphragm 46 in a fixed position with respect to housing 38 and support ring 50. Rod 66, sleeve 68 and crimping ring 70 are then moved away from housing support structure 64 and the performed diaphragm subassembly is removed from housing support fixture 64.

Curved surface 72 of rod 66 in FIG. 3B employed to preform vibratile diaphragm 46 to the desired shape may also be derived from the corresponding surface of the backplate that forms a part of the complete transducer assembly. This could be accomplished by combining a modified form of rod 66 with, for example, backplate 54 in transducer assembly 36 illustrated in FIGS. 2A and 2B.

As shown in FIG. 3B rod 66 would be in the form of a right circular cylinder whose lower end would terminate at line 73 and portion 75 of said rod 66 would then be replaced by said backplate 54. Diaphragm 46 would be preformed in the same manner that said diaphragm 46 was preformed by rod 66 with its curved end surface 72. After vibratile diaphragm 46 is so preformed, said modified rod would be withdrawn from support ring 50 leaving backplate 54 within support ring 50 and the curved surface of said backplate 54 in contact with vibratile diaphragm 46. Leaf spring 56 (FIG. 2B) would then be inserted through openings 58 (FIG. 2B) in support ring 50 until the center portion of said spring 56 pressed on backplate 54 and the ends of said spring 56 rested on or were reacted against the walls in openings 58 of said ring 50.

Figure 4A:
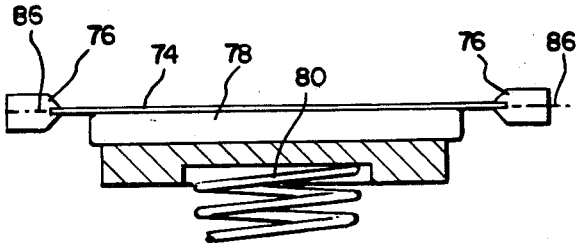
FIG. 4A (PRIOR ART)
FIG. 4A is an elevational view of a portion of an electroacoustical transducer showing a flat diaphragm in contact with a flat backplate in accordance with the teachings of the prior art.

FIG. 4A is a sectional view, in elevation, of a portion of an electroacoustical transducer, showing the flat diaphragm of said transducer in contact with a flat backplate surface in accordance with the teachings of the prior art. Diaphragm 74 is maintained in a planar orientation by tensioning means 76 that is supported by a conventional transducer housing member (not shown). A relatively flat surface of backplate 78 cooperatively engages said diaphragm 74 and said cooperative engagement is maintained by spring 80. Even though a relatively flat backplate surface engages a relatively flat diaphragm, a wrinkle creating stress pattern is introduced into said diaphragm 74 by such diaphragm 74 and backplate 78 engagement. The stress pattern introduced into diaphragm 74 is more clearly illustrated in the top view of diaphragm 74 illustrated in FIG. 4B.

Figure 4B:
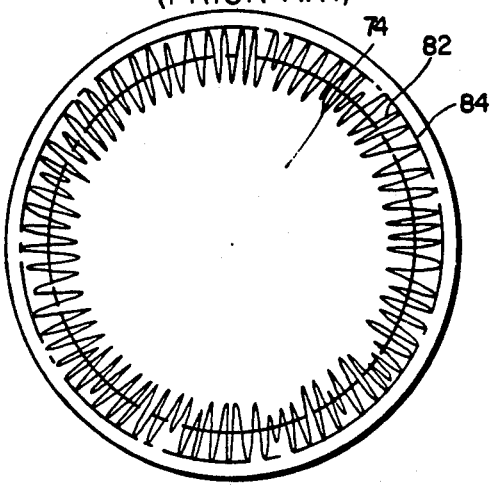
FIG. 4B (PRIOR ART)
FIG. 4B is a top view of the diaphragm in FIG. 4A showing the stress pattern in said diaphragm.

In FIG. 4B, reference numeral 82 designates the outer limit of the interface between diaphragm 74 and backplate 78 (FIG. 4A), and reference numeral 84 designates the inner limit of the diaphragm 74 and support means 76 interface. As can be seen in FIG. 4B, wrinkles extend into the interface between diaphragm 74 and backplate 78 which reduces the contact between these components which, in turn, reduces transducer efficiency and sensitivity. While the degree of wrinkling in diaphragm 74 is less than in a flat diaphragm that subsequently engages a curved backplate surface, the degree of wrinkling is enough to reduce transducer efficiency and sensitivity. This reduced efficiency and sensitivity can be avoided by offsetting the inner region of diaphragm 74 from plane 86 which extends through the interface between diaphragm 74 and tensioning means 76, by the method that was previously discussed. Such an arrangement is depicted in FIG. 5A.

Figure 5A:
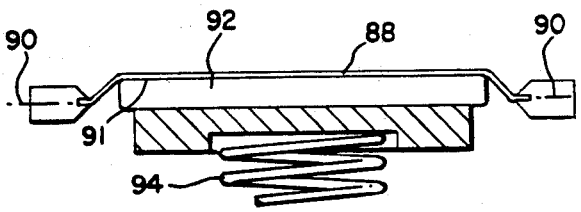
FIG. 5A is an elevational view of a portion of an electroacoustical transducer showing an offset diaphragm in contact with a flat backplate in accordance with an embodiment of the present invention.

In FIG. 5A, a sectional view, in elevation, of a portion of an electroacoustical transducer having offset diaphragm 88 in contact with a flat backplate surface in accordance with the teachings of the present invention, is depicted. The periphery of diaphragm 88 is maintained in a planar orientation by tensioning means 90, said tensioning means 90 being supported by a conventional transducer housing member (not shown). The inner region of diaphragm 88 was offset from plane 90 through the periphery of said diaphragm 88 prior to the time that flat surface 91 of backplate 92 was brought into engagement with diaphragm 88 and maintained in said engaged position by spring 94. Any wrinkles introduced into diaphragm 88 by the cooperative engagement of said diaphragm 88 with surface 91 of backplate 92 occur in the outer portion of the inner region of diaphragm 88 and not in that portion of said diaphragm 88 that contacts surface 91 of backplate 92. The location of the wrinkles in diaphragm 88 after full engagement with backplate 92 are more clearly illustrated in the top view of said diaphragm 88 which is illustrated in FIG. 5B.

Figure 5B:
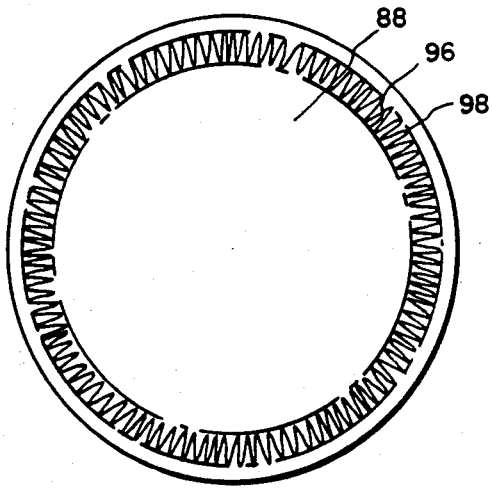
FIG. 5B is a top view of the diaphragm in FIG. 5A showing the stress pattern in said diaphragm.

In FIG. 5B, reference numeral 96 designates the outer limit of the interface between diaphragm 88 and backplate 92 (FIG. 5A), and reference numeral 98 designates the inner limit of the diaphragm 88 and support means 90 interface. As can be seen in FIG. 5B, the wrinkles in diaphragm 88 move to the region between limits 96 and 98 when backplate 92 fully engages diaphragm 88 which increases the contact between these components which, in turn, increases transducer efficiency and sensitivity over the transducer arrangement depicted in FIG. 4A.

Figure 6A:
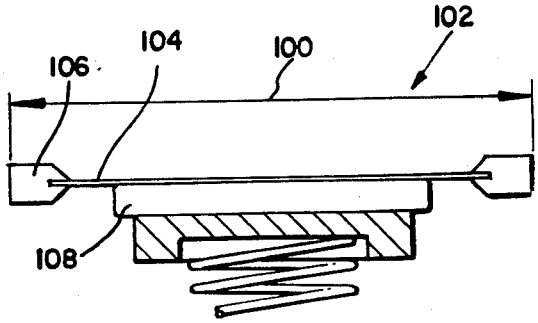
FIG. 6A (PRIOR ART)
FIG. 6A is an elevational view of a portion of a prior art electroacoustical transducer having a relatively large cross section.

In addition to improving transducer efficiency and sensitivity, the present invention may also be utilized to reduce transducer profile. In FIG. 6A, reference numeral 100 designates the major profile dimension of conventional electroacoustical transducer 102. Transducer diaphragm 104 is maintained in a planar orientation by tensioning means 106 which extend substantially beyond the outer limits of cooperatively engaged backplate 108. The housing for transducer 102 needs to be large enough to encompass diaphragm 104 tensioning means 106. Dimension 100 can be significantly reduced by offsetting diaphragm 104 prior to its engagement with backplate 108. Such an arrangement is depicted in FIG. 6B.

Figure 6B:
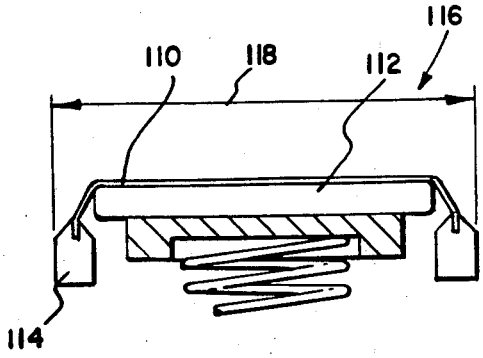
FIG. 6B is an elevational view of a portion of an electroacoustical transducer having an offset diaphragm that results in a transducer of reduced cross section over the transducer depicted in FIG. 6A.

In FIG. 6B, an elevational view of a portion of an electroacoustical transducer having an offset diaphragm that results in a transducer of a reduced cross section over those in the prior art, is depicted. In FIG. 6B, diaphragm 110 has been preformed or offset prior to its engagement with backplate 112 which enables diaphragm 110 tensioning means 114 to be moved nearer to the center of transducer 116 which results in a reduced profile dimension at reference numeral 118 over, for example, profile dimension 100 in FIG. 6A. This reduced profile dimension makes it possible to reduce the transducer housing adjacent said dimension 118.

GENERAL CONSIDERATIONS

In the preferred embodiment described herein, a relatively inelastic material was utilized for the vibratile diaphragm. While a nonoffset diaphragm made from an elastic material can be uniformly tensioned by a mating backplate without introducing wrinkles into said material, such a material is unsuitable for electroacoustical transducer diaphragms because when placed under tension, diaphragm thickness becomes nonuniform, and the tension in such diaphragms tends to diminish over an extended period of time, both of which unfavorably affect transducer performance.

In the preferred embodiment of the present invention, the inner region of vibratile diaphragm 46 was offset by rod 66 of assembly tool 61 before a force was applied to support ring 50 by sleeve 68 of said tool 61 to maintain the periphery of said diaphragm 46 in a fixed position with respect to housing member 38 during the time that said housing 38 was being crimped to said support ring 50. This particular sequence of steps was made possible by attaching paper and therefore collapsible tensioning ring 48 to the periphery of said diaphragm 46 to place a uniform radially outward force on said diaphragm while the inner diaphragm region was being offset. If a tensioning ring or a suitable adhesive was not so utilized, an alternate method for offsetting said inner diaphragm region would be to interpose the periphery of diaphragm 46 between the flanged portion of support ring 50 and the flanged portion of housing 38 and then apply a relatively light force to said support ring 50 by sleeve 68. The amount of force applied to support ring 50 by sleeve 68 would be less than that required to offset the inner region of diaphragm 46 so that the periphery of said diaphragm 46 can move uniformly inward as the inner diaphragm region is being offset. Housing 38 would be crimped onto support ring 50 after the inner diaphragm region had been offset, which would place the periphery of said diaphragm 46 in a fixed position with respect to housing member 38.

The degree of inner region diaphragm offset may exceed, but should not be less than that needed to insure uniform contact between said diaphragm region and the electrically conductive surface of a mating transducer backplate at a final diaphragm tension level that will insure optimum transducer efficiency and sensitivity. Offsetting the transducer diaphragm beyond the degree that will insure such uniform contact will not provide any further improvement in transducer efficiency or sensitivity, but may be useful in, for example, reducing transducer profile.

It will be apparent to those skilled in the art from the foregoing description of our invention that various improvements and modifications can be made in it without departing from its true scope. The embodiments described herein are merely illustrative and should not be viewed as the only embodiments that might encompass our invention.

What is claimed is:

1. A method for mounting a diaphragm in an electroacoustical transducer assembly of the type having a housing member with an opening therein, an electrostatic vibratile diaphragm formed of a pliant, relatively inelastic material having a conductive and a nonconductive surface, a substantially inflexible backplate member having a grooved surface and a spring, comprising the steps of;

placing said diaphragm adjacent said housing member such that said diaphragm extends across said housing member opening;

applying uniform, radially outward forces to said diaphragm for the purpose of temporarily maintaining at least the inner region of said diaphragm in a generally wrinkle-free planar orientation;

placing the grooved surface of said backplate member in contact with an inner region of the insulative surface of said diaphragm;

applying a force to said backplate member, in excess of said radial forces on said diaphragm, for the purpose of offsetting said inner diaphragm region from its said planar orientation to thereby increase the total amount of said diaphragm extending across said housing opening over that extending across said housing opening before the application of said inner region offsetting force, said offsetting force overcoming said radial forces, thereby enabling additional amounts of said diaphragm to move uniformly inward as said inner diaphragm region is being so offset;

securing an outer region of said diaphragm in a fixed position with respect to said housing member while said inner diaphragm region is in its said offset condition; and inserting said spring into said assembly such that portions of said spring are reacted against said housing member and a portion of said spring presses on said backplate member to maintain said grooved portion of said backplate in contact with a portion of said offset inner diaphragm region.

* * * * *